United States Patent [19]

McLaren

[11] 4,139,119

[45] Feb. 13, 1979

[54] SIFT PROOF CARTON

[75] Inventor: Edwin C. McLaren, Apple Valley, Minn.

[73] Assignee: Champion International Corporation, Stamford, Conn.

[21] Appl. No.: 873,353

[22] Filed: Jan. 30, 1978

[51] Int. Cl.[2] ..... B65D 5/56

[52] U.S. Cl. ..... 220/418; 220/461

[58] Field of Search ..... 229/14 BA, 14 BL; 220/418, 461

[56] References Cited

U.S. PATENT DOCUMENTS

| | | | |
|---|---|---|---|
| 2,305,771 | 12/1942 | Yates | 229/14 B |
| 3,040,963 | 6/1962 | Turpin | 229/14 BL UX |
| 3,799,428 | 3/1974 | Lamming | 229/3.5 MF X |

*Primary Examiner*—Davis T. Moorhead

*Attorney, Agent, or Firm*—Evelyn M. Sommer

[57] ABSTRACT

A paperboard carton is provided with an upper and lower continuous thermoplastic liner adhesively connected in spaced relation to the walls of the carton to form with the walls, a pouch for the contents of the carton. The pouch eliminates the need of a separate foil, glassine, plastic or like receptacle within the interior of the carton to preclude the contents from sifting through the walls and to provide an effective seal once the carton is opened, so as to maintain the carton contents, such as food, fresh.

4 Claims, 8 Drawing Figures

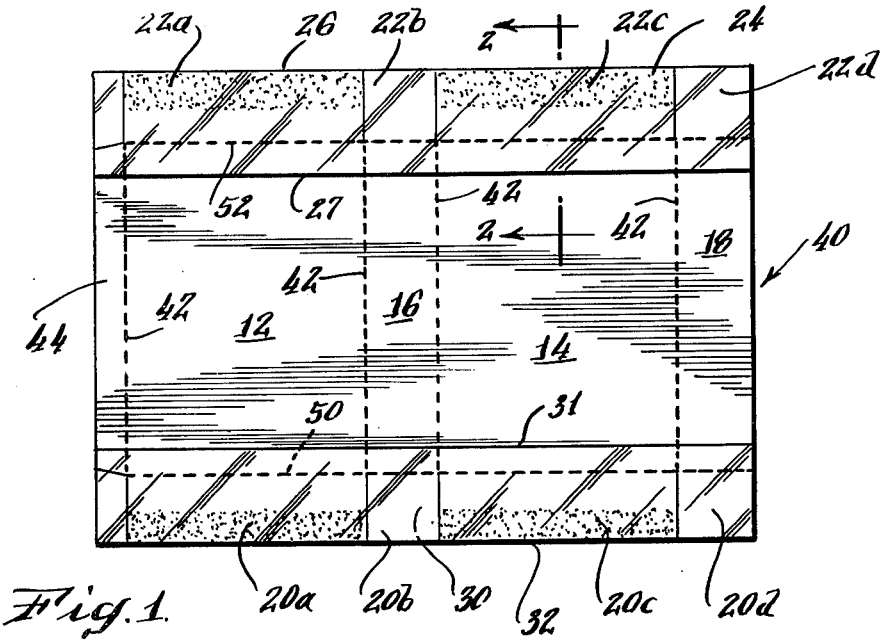
Fig. 1.
Fig. 2.
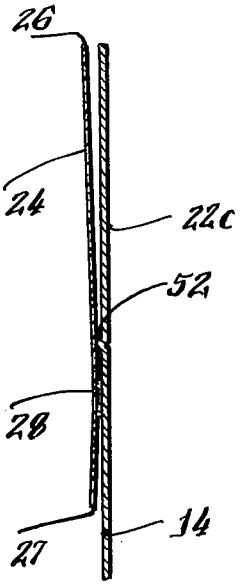
Fig. 3.
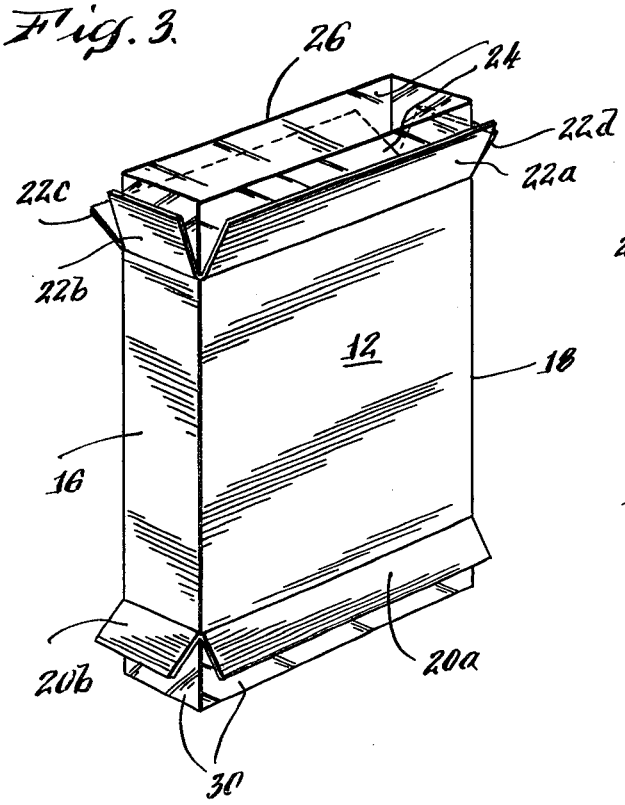
Fig. 4.
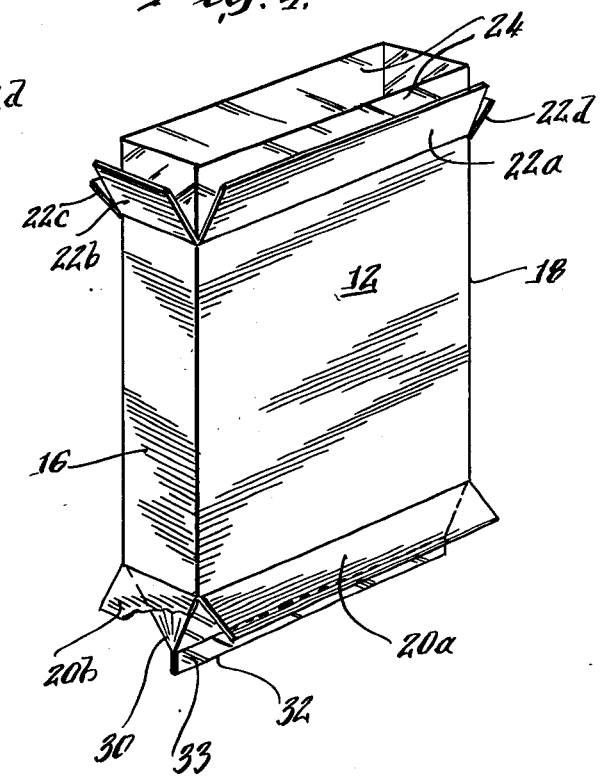

SIFT PROOF CARTON

BACKGROUND OF THE INVENTION

1. Field of the Invention

This invention relates to a carton construction, and more particularly, a carton construction provided with an integrated, impervious liner which serves as a moisture barrier insuring freshness of the carton contents. The liner also prevents seepage of the carton contents through the carton walls.

2. Description of the Prior Art

Products that have sifting characteristics generally require a pouch inside the carton which is filled with the product. The pouch, which is formed from materials such as foil, glassine or plastic film is sealed to assure freshness and to prevent sifting through the carton walls of items such as sugar substitutes, cake mix, grass seed, detergents, etc. After the package is opened and some of the product consumed, the pouch provides a recloseable feature to minimize such sifting and to help assure freshness. Products having powdery or fine particle characteristics in the absence of such a pouch, would seep or sift through the carton walls particularly where the flaps of the carton are joined.

Such pouches materially raise the cost of production of the carton and require special assembly machinery. The sift proof carton of the present invention provides the requisite product protection, as heretofore, but results in reduced costs of production by materially saving material. Furthermore, the carton can be manufactured on existing production equipment and requires no special flap fold sequence or pattern glue, so the carton can be closed on any standard cartoning equipment.

SUMMARY OF THE INVENTION

In accordance with the invention, a standard rectangular carton blank is provided with a plastic liner glued in a strip along the upper and lower major horizontal fold lines of the blank. When the blank panels are folded and sealed into its rectangular parallelopiped configuration, the ends of each liner are sealed. The facing bottom edges of the lower liner are then sealed, whereby the carton side walls and lower liner form a pouch within the interior of the carton. The top edges of the upper liner are fused to seal the food, detergent, seed or other contents in the "pouch" and after the seal is broken by a consumer by pulling these edges apart, the edges can be rolled together to reseal the "pouch", maintaining the sift proof nature of the carton and providing a moisture and air barrier in the carton to assure continued freshness of the contents.

BRIEF DESCRIPTION OF THE DRAWING

Further objects and advantages of the invention will become apparent from the following description and claims, and from the accompanying drawings, wherein:

FIG. 1 is a plan view of a blank having upper and lower liners, which when folded, forms the sift proof carton of the present invention;

FIG. 2 is a cross-sectional view taken substantially along the plane indicated by line 2—2 of FIG. 1;

FIGS. 3 to 5 are front perspective views of a partially assembled carton of the present invention illustrating various stages of construction thereof;

DETAILED DESCRIPTION OF THE PREFERRED EMBODIMENT

Figure 5:
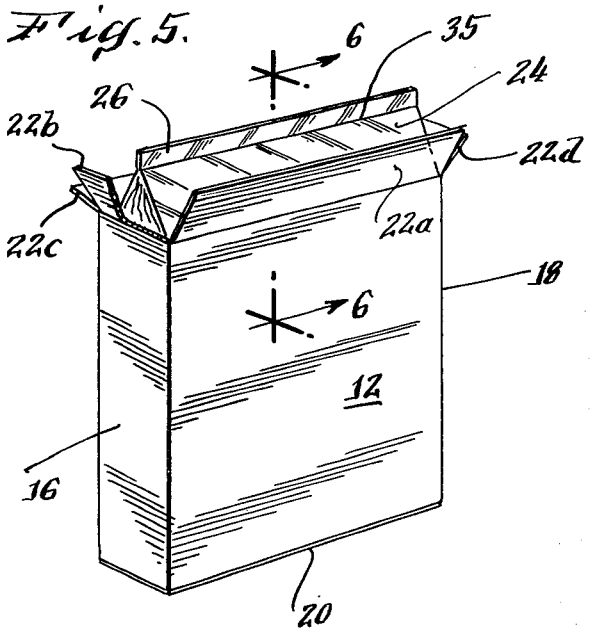
Figure 6:
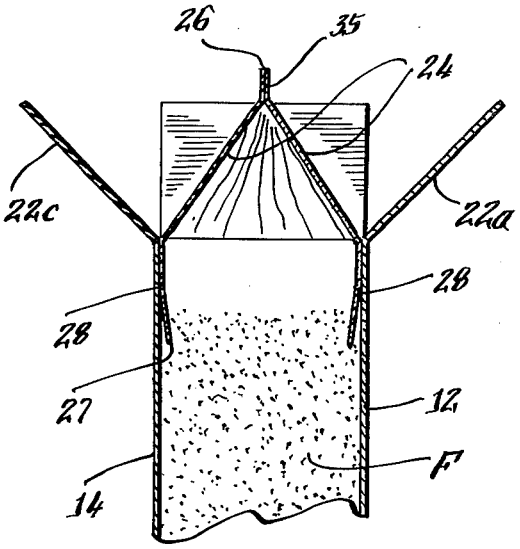
FIG. 6 is a cross-sectional view taken substantially along the plane indicated by line 6—6 of FIG. 5.
Figure 7:
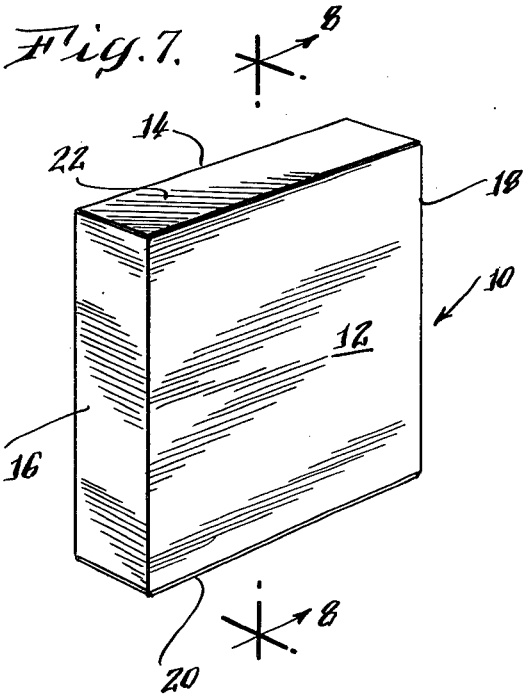
FIG. 7 is a front perspective of the assembled carton of the present invention.
Figure 8:
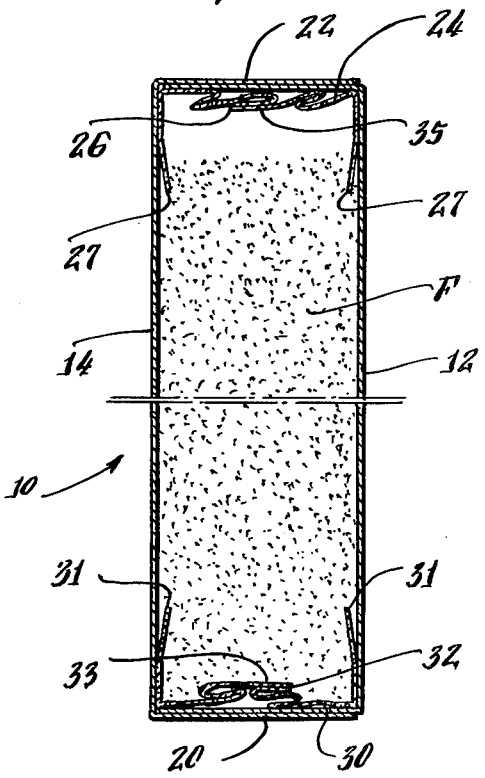
FIG. 8 is a cross-sectional view taken substantially along the plane indicated by line 8—8 of FIG. 7.

Referring now to the drawing in detail, wherein like numerals indicate like elements throughout the several views, the sift proof carton 10 of the present invention includes front and rear walls 12 and 14, connected by opposed sidewalls 16 and 18, which forms a rectangular parallelopiped enclosure. A bottom wall 20 and a top wall 22 complete the outer portions of the carton 10.

Disposed within carton 10 is an upper strip of flexible thermoplastic sheeting 24 adhesively connected intermediate its top edge 26 and bottom edge 27 to the front, rear and sidewalls of carton 10 by a line of adhesive 28. Adhesive line 28 constitutes an integral part of the sift proof seal. Spaced from upper strip 24 is a lower strip of flexible thermoplastic sheeting 30 adhesively connected intermediate its top edge 31 and bottom edge 32 to the front, rear and sidewalls of carton 10. The bottom edge 32 of lower strip 30 is fused together by heat along a ridge 33 and after food is inserted within the carton 10, the top edge 26 of upper strip 24 is heat sealed along facing surfaces to form a ridge or fine seal 35. The sealed strips 24, 30 and the front wall 12, rear wall 14, and sidewalls 16, 18 of carton 10 define a resealable "pouch" to prevent food, detergent, seed particles F from sifting through the joined edges of the outer surfaces of carton 10. Furthermore, the ridge 35 of strip 24 can be broken to remove a portion of the contents disposed within the "pouch" in carton 10 and the edges rolled together, to reseal the "pouch", maintaining the contents in the interior of the "pouch" fresh.

As shown in FIGS. 1 to 5, the carton 10 is formed from a single blank 40. Blank 40 includes rectangular panels 12, 14, 16 and 18 corresponding to the front, rear and opposed sidewalls of carton 10, which are folded 90° relative to each other about vertical score lines 42 joining the panels to each other. A glue flap 44 connected to panel 12 by a score line 42, seals panel 12 to panel 18.

Bottom wall 20 is formed by flaps **20*a*, 20*b*, 20*c*, and 20*d* connected to panels 12, 16, 14 and 18, respectively, by a major horizontal score line 50. Top wall 22 is formed by flaps 22*a*, 22*b*, 22*c*, and 22*d* connected to panels 12, 16, 14, and 18, respectively, by a second major horizontal score line 52. The top wall and bottom wall flaps are folded 90° about score lines 52 and 50, respectively, the top flaps are then overlapped, and the outer surface of flap 20*c* adhesively connected to the inner surface of flap 20*a*. The bottom flaps are similarly overlapped and the outer surface of flap 22*c* adhesively connected to the inner surface of flap 22*a***.

Upper strip 24 is adhesively connected to the panels 12, 14, 16 and 18 just below score line 52 (FIG. 2) prior to folding blank 40. Similarly, lower strip 30 is adhesively connected to the panels 12, 14, 16 and 18 just above score line 50. As shown in FIG. 1, the ends of liners 24 and 30 extend beyond the free edges of flaps **22*a* and 20*a* and above and below the glue flap 44 so as to present a surface which can be fused to the other end of each strip liner when the glue flap 44 is connected to the interior of sidewall 18**.

What is claimed is:

1. A sift proof carton comprising: a front wall, a rear wall, and opposed side walls connected to said front and rear walls, a top wall connected to said side walls, a bottom wall connected to said side walls, an upper liner member adhesively connected intermediate its top edge and bottom edge to the front, rear and side walls of the carton such that the top and bottom edges of said upper liner member are free from said carton, the bottom edge of said upper liner member being movable towards the inner portion of the carton to inhibit shifting of material contained in the carton, a lower liner member adhesively connected intermediate its top edge and bottom edge to the front, rear and side walls of the carton such that the top and bottom edges of said lower liner member are free from said carton, the top edge of said lower liner member being movable towards the interior portion of the carton to inhibit shifting of material contained in the carton, the lower edge of said lower liner member being sealed together, and the upper edge of said upper liner members being sealed together.

2. The carton of claim 7 wherein said strip liners are formed from flexible thermoplastic.

3. The carton of claim 1 wherein said strip liners are formed from flexible foil.

4. The carton of claim 1 wherein said carton is formed from paperboard.

* * * * *